US007861385B1

(12) United States Patent
Meyer

(10) Patent No.: US 7,861,385 B1
(45) Date of Patent: Jan. 4, 2011

(54) PERPETUAL MEMORIAL CARD

(76) Inventor: Kenneth A. Meyer, 2185 Ben Jon Rd., Easton, PA (US) 18040

( * ) Notice: Subject to any disclaimer, the term of this patent is extended or adjusted under 35 U.S.C. 154(b) by 0 days.

(21) Appl. No.: 12/017,801

(22) Filed: Jan. 22, 2008

Related U.S. Application Data

(60) Provisional application No. 60/886,041, filed on Jan. 22, 2007.

(51) Int. Cl.
*A61G 17/00* (2006.01)

(52) U.S. Cl. ..... 27/1; 40/124.5

(58) Field of Classification Search ..... 27/1; D99/5; 206/37; 40/124.5, 722, 724, 725; 428/913.3, 542.4
See application file for complete search history.

(56) References Cited

U.S. PATENT DOCUMENTS 2,009,724 A * 7/1935 Bircher ..... 27/1
3,167,844 A * 2/1965 Bachofner ..... 27/1
4,199,848 A * 4/1980 Kohnert ..... 27/1
5,379,499 A * 1/1995 Jackson ..... 27/1
5,625,933 A * 5/1997 Neuberger et al. ..... 27/1
5,950,287 A * 9/1999 Cacciatore et al. ..... 27/1
5,950,288 A * 9/1999 Bach Lahor ..... 27/1
6,665,916 B1 * 12/2003 Santorello et al. ..... 27/1
7,082,653 B1 * 8/2006 Sueppel ..... 27/1
7,373,703 B1 * 5/2008 Grenci ..... 27/1
2004/0261236 A1 * 12/2004 Poirier ..... 27/1
2006/0207075 A1 * 9/2006 Davis ..... 27/1
2008/0060176 A1 * 3/2008 Kopicki ..... 27/1

* cited by examiner

*Primary Examiner*—William L. Miller
(74) *Attorney, Agent, or Firm*—Clinton H. Wilkinson; Charles A. Wilkinson

(57) ABSTRACT

A perpetual memorial or legacy card comprised of polycarbonate card having a small quantity of human cremains sealed within said card, and furthermore having graphical and textual material on the front and rear faces of the card, that can be carried in a pocket or wallet, with the card serving as a remembrance of the deceased.

8 Claims, 5 Drawing Sheets

PERPETUAL MEMORIAL CARD

REFERENCE TO RELATED APPLICATION

This application claims the benefit of U.S. Provisional Application 60/886,041 filed Jan. 22, 2007 by the present inventor.

BACKGROUND OF THE INVENTION

1. Field of the Invention

The present invention relates to devices for perpetuating the memory of loved ones, and more particularly to a memorial card in which are contained the cremation ashes of a loved one.

2. Description of Related Art

It is of course well known in human history to memorialize or commemorate the passing of human beings. In addition to burial in the ground or entombment in a crypt, the other common method of final disposition of a body is through cremation, after which the cremation ashes, or "cremains", of the deceased are offered to his or her next of kin or family. Depending on factors such as family tradition and the religion of the deceased, the next of kin or family of the deceased may keep the ashes, or may release then in a special area, typically as instructed by the deceased prior to his or her passing, such as on a hillside or field, or in the sea, or bury them in the ground.

The prior art contains numerous receptacles for holding and displaying cremation ashes, such as urns, monuments, and other decorative articles. Also disclosed in the prior art are numerous other devices and methods for perpetuating the memory of a loved relative, friend, or pet. As far as the present inventor is aware, however, none of such devices are suitable for holding or carrying a small quantity of cremation ashes of a loved one on or in close proximity to one's person such as in a pocket, wallet, or purse at all times so that it is available to be held during a prayer or the like whenever desired, and which in addition contains relevant information about such person. The most relevant-appearing prior art references known to the present inventor are summarized below.

U.S. Pat. Nos. 5,158,174 and 5,208,957 both issued to W. M. Hereford and entitled "Jewelry Container for Cremation Ashes" and "Process of Encapsulating Cremation Ashes Within a Jewelry Container", respectively, disclose a jewelry item having a cavity for receiving a hermetically sealed container specifically adapted for holding cremation ashes. While designed to hold the memory of a loved one in close proximity to one's body, in Hereford's arrangement the cremation ashes are carried with or by a survivor or survivors of the deceased only when the jewelry item is worn, and in addition no information about the deceased is provided on or with the jewelry item.

U.S. Pat. No. 5,349,727 issued to G. Niebergall, entitled "Storage Container for Cremation Ashes", discloses a cremation ashes storage and display container wherein the ashes are stored in a transparent plastic inner container. As shown in FIG. 1, the inner plastic container has a circular opening through which the ashes are inserted in the container, after which a cap is sealed over the opening by a bonding or welding process. The Niebergall container is not portable, however, and does not teach a memorial or legacy card for containing a small amount of ashes to be used as a remembrance.

U.S. Pat. No. 5,625,933 issued to C. G. Neuberger et al. entitled "Storage Container and Display for Cremated Remains", discloses a rectangular memorial urn for containing cremation ashes having a means for adding a decorative panel to the urn. The urns are constructed so that multiple urns can he stored side-by-side on a wall, and thus Neuberger also teaches a funeral urn storage system, but not a memorial card as in the present invention.

U.S. Pat. No. 5,755,116 issued to A. G. Sparacino et al. entitled "Remembrance Preserving Jewelry and Method for Its Use", discloses a bracelet or locket having a chamber or cavity in which remembrance items such as a locket of hair or cremation ashes can be permanently sealed. While useful for those who enjoy wearing lockets, bracelets and other jewelry items, the Sparacino remembrance holder it not designed to be slim so that it can be carried unobtrusively in a wallet or the like, and does not contain any additional information about the person being remembered.

U.S. Pat. No. 5,950,287 issued to V. Cacciatore entitled "Apparatus for Containing Cremation Ashes and Displaying a Photograph" discloses a jewelry item for containing cremation ashes that can be formed as a locket, pendant or bracelet charm having a transparent face in which a photograph facing outwardly is placed, with the cremation ashes of a loved one placed in the locket behind the photograph, after which the locket is sealed. The cremation ashes and photograph are both visible through the transparent face of the jewelry item. The jewelry item apparently is not permanently sealed, however, which can lead to an accidental and upsetting loss or contamination of its contents. A memorial card also is not disclosed.

U.S. Pat. No. 6,112,382 issued to D. J. Parker et al. entitled "Combination Lawn/Garden Ornament and Cremation Container", discloses another cremation ashes container which can be mounted in a lawn ornament in various forms such as a wind chime, stepping stone, pedestal, or planter. The Parker cremation ash containers are not portable and apparently are not permanently sealed, although the ashes are preferably placed in a plastic bag prior to being inserted in the container and ornament.

U.S. Pat. No. 6,322,862 issued to T Sakai entitled "Pressed Flower Enclosed Article", discloses a decorative article for containing pressed or dried flowers which retains their natural beauty including a base layer, an intermediate layer of molten resin in which the pressed flower is sealed, and a surface layer comprised of a transparent film, which layers are laminated together. Sakai further indicates that the article may be used as a memorial card or for various other decorative purposes. Sakai therefore shows generally a memorial card having an integral object in the form of a pressed flower laminated in the card, but does not disclose a memorial or legacy card wherein a small quantity of cremation aches are in the card.

U.S. Pat. No. 6,347,439 issued to S. Bach Lahor entitled "Self-Mountable Niche for Remains Ashes" discloses a system for encasing and displaying cremation ashes in an urn or the like including a closed box having a transparent window which, as shown in FIGS. 5 and 6, is mountable to a wall or other vertical surface. While ornamentation such as a photograph may be included next to the ashes to identify the remains, such system is not portable, and other than holding cremation ashes is unrelated to the present inventor's memorial or legacy card.

U.S. Pat. No. 6,463,703 issued to M. P. Mattis entitled "Burial Monument with Memorabilia Storage Device" illustrates a monument such as a gravestone or park bench having a compartment therein for storing a memorabilia container. While illustrative of another alternative cremation ashes container, otherwise such arrangement is not similar to the present invention.

U.S. Pat. No. 6,510,596 issued to M. A. McCarthy entitled "Crematory Egg Interment System" discloses a system and method for preparing an eggshell for use as an ash remembrance container for the ashes of an animal. A picture of the animal may be painted on the outside of the eggshell. Such container is not meant to be carried on one's person in a purse or wallet sleeve, however.

U.S. Pat. No. 6,532,634 issued to B. Wilson-Brokl entitled "Cremated Remains Display Upon a Substrate System and Method Therefore" discloses a system for incorporating the ashes of a loved one into a substrate such as a picture or work of art. The ashes are basically sprinkled in the wet paint used in the artwork.

U.S. Pat. No. 6,665,916 issued to M. Santorella et al. entitled "Ash Silhouette Display Device" discloses a wail plaque or urn having a silhouette of the deceased cut therein, in which silhouette a quantity of ashes of the deceased are placed, over which a translucent panel is secured. Other decorative graphics may be placed on the outer surface of the display.

U.S. Patent Application Publication 2005/0005409 published on Jan. 13, 2005, entitled "Portable Grave Time Capsule", filed by G. Elnatan, discloses a container having three internal chambers, two of which chambers are arranged to contain DNA material and ashes of the deceased, while the third chamber contains a computer memory chip. The chip may contain biographical, photographic, voice, and other data about the deceased, and may be downloaded to a computer. The Elnatan container is not meant to be carried by a loved one of the deceased as a remembrance of such person, however.

U.S. Patent Application Publication 2005/0081561 published on Apr. 21, 2005, entitled "Pendant for Carrying Remembrances Such as Cremation Remains and Method for Manufacturing the Same", filed by D. Eggleston, discloses a hermetically sealed pendant for containing ashes or other remembrance items. The pendant is made of metal, the panels of which are laser sealed to permanently enclose the remembrance material in the pendant without damaging such material during the sealing process. Similar to the Hereford jewelry items discussed above, the Eggleston pendant is not meant to be carried in a wallet, purse or pocket, and contains no information about the deceased.

As is demonstrated by the prior art discussed above, a drawback of most known remembrance devices and methods is that most are not portable, and cannot be carried with a spouse, relative or other person at all times. In addition, those cremation ash containing devices known to the present inventor that are portable are all in the form of jewelry items such as lockets, bracelets, and the like, which must be worn for the remembrance item to be carried on one's person, and with such devices, furthermore, there is a greater risk that the ashes may be inadvertently released from the holder.

Laminated and non-laminated prayer cards, mass cards, and memorial cards having information such as a photograph, the name of the deceased, and dates of birth and death on one side, and a prayer or other saying on the other side, are also well known and are commonly manufactured by many merchants. Lamination allows long-term use and provides that the product will normally be impenetrable to all types of weather, sealing the contents, and is durable and will remain intact. An example of a laminated memorial card is shown at the website address <memorialprint.com>, which company manufactures memorial cards and sells them directly to funeral directors and to the general population. None of such memorial cards is designed to hold or contain a small amount of the cremation ashes of a loved one, however.

While the prior art devices discussed above are thus useful for their own particular indicated purposes, none exhibits the particular features of the present inventor's memorial card remembrance article and method, whereby the next of kin, family members, or friends of a deceased loved one can have a personalized remembrance items of such deceased person designed to be easily carried in a wallet, purse, coat pocket or the like at all times so that it can be retrieved and referred to during prayer of the like.

OBJECTS OF THE INVENTION

It is therefore a primary object of the present invention to provide a device and method for perpetuating the memory of a loved one that can be easily carried on one's person or in one's wallet or handbag.

It is a further object of the present invention to provide a credit-card sized base and cap system made from a polycarbonate resin thermoplastic such as Lexan® with dual side labeling having a small quantity of cremation ashes or cremains permanently sealed in said card, to serve as a remembrance item of a deceased loved one.

It is a further object of the invention to provide a cremation ashes or cremains containing sealed card having appropriate memorial material identifying and commenting upon a deceased.

Still other objects and advantages of the invention will become clear upon review of the following detailed description in conjunction with the appended drawings.

SUMMARY OF THE INVENTION

The memorial or legacy card article of the present invention consists of a card structure which in its preferred embodiment is the size of a credit card although three times the depth (0.90 mm) having on its faces graphical and textual material such as information about the deceased, a photograph, a religious prayer, or any other desirable material, which card graphics and text can be a design selected either by loved ones of the deceased, by the deceased prior to his or her passing, or a stock design from a software program or the like. In one embodiment, provided is a single card base having an internal aperture or pocket in which a small amount of cremation ashes of a deceased loved one can be placed, after which the aperture or pocket is sealed and the graphics applied to the outer surfaces of the card. In another embodiment, the card is formed between two laminates, one of which contains a pocket for holding a small amount of cremation ashes, while in yet another embodiment the card consists of two parts, a base with a cavity for the cremains and a cap that will seal the cremains in the cavity, with graphic and textual material provided on the front and rear faces of the card, using permanent labels to add additional security to the memorial card. The memorial cards of the present invention are designed to be marketed directly to the public or through a funeral home attending to the final disposition of a body.

DESCRIPTION OF THE PREFERRED EMBODIMENTS

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

Figure 1:
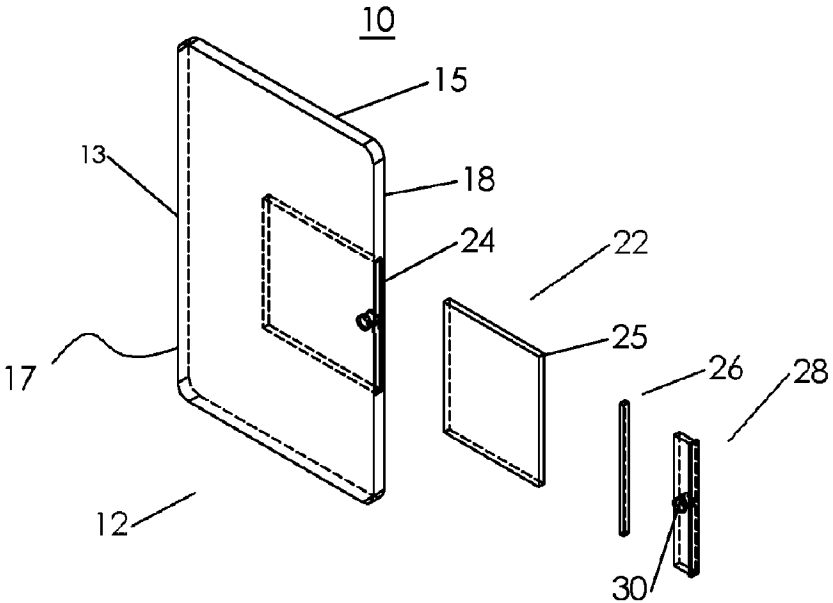
FIG. 1 is a perspective exploded view of a preferred embodiment of the memorial or legacy card of the present invention.
Figure 3:
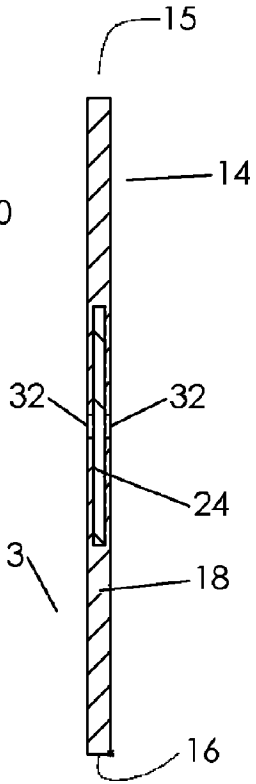
FIG. 3 is a sectional side view of the card base shown in FIGS. 1 and 2 taken along line A-A in FIG. 2 in the direction of the arrows indicated.
Figure 2:
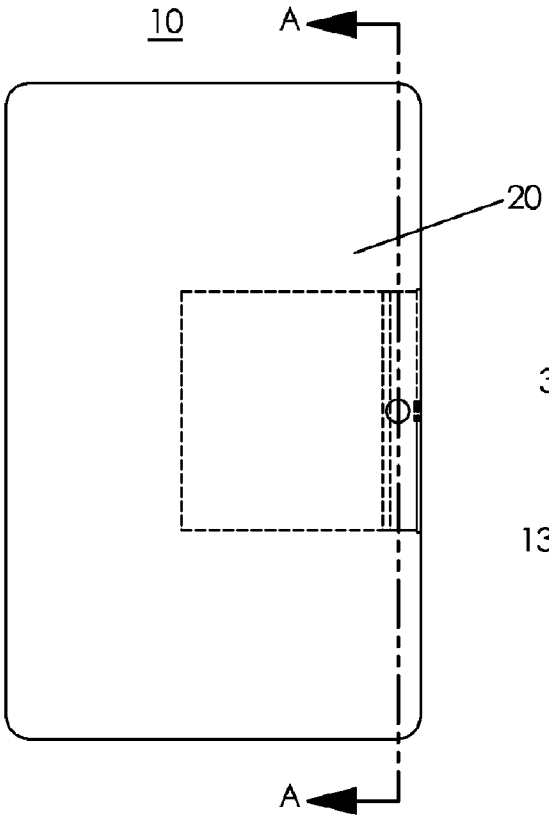
FIG. 2 is a front view of the card base shown in FIG. 1.

Referring now to FIGS. 1-3, there is shown a first preferred embodiment of the memorial or legacy card 10 of the present invention, which card 10 includes a card base 12 having a front surface 13, rear surface 14 (see FIG. 3) directly opposite and preferably in parallel alignment with front surface 13, an upper edge 15, a lower edge 16, a first side edge 17, and a second side edge 18. Card base 12 is preferably made of a semi-rigid plastic material such as PVC or Polycarbonate or other suitable material, which material is sufficiently thick to give the card base 12 some rigidity while still being as thin as reasonably possible. In one preferred embodiment, card base 12 is dimensioned to be of standard credit card size and identical to an industry standard CR-80 card specifications, or approximately 54 mm by 85.5 mm, and having a thickness of about 0.90 mm, although it will be understand that such card base may have greater or lesser dimensions as desired while still falling within the intended scope of the present invention.

A pocket or cavity 20, indicated by dotted lines in FIG. 2, is provided in card base 12 between front and rear surfaces 13 and 14 (see FIGS. 2 and 3), which pocket or cavity 20 is preferably integrally formed during molding of card base 12 and is designed to receive and permanently hold a small amount of cremation ashes of a loved one. More particularly, in the presently described embodiment ashes 22 are inserted through slot or opening 24 in second side edge 16 of the card base 12. As shown in FIG. 1, although the ashes 22 could be inserted directly into pocket 18 with or without the aid of a small tool or implement, it is preferred that prior to insertion into pocket 18 such ashes are first applied to a thin tape or foil 25, or other suitable thin sheet material, which is then inserted into cavity 20 through slot 24. The use of a tape or foil aids in maintaining the ashes evenly distributed in the pocket. After placement of tape 25 holding cremation ashes 22 into pocket 18, an adhesive strip 26, preferably comprised of a silicone polymer, is inserted in opening 24 to prevent the ashes 22 and tape or foil 25 in pocket 20 from spilling out. Then, a further plastic seal or lid member 28 is inserted in slot 24 over adhesive strip 26. Lid member 28 preferably includes a pair of alignment tabs 30 extending outwardly from its side surfaces which fit into matching grooves 32 in slot 24 so as to ensure that lid member 28 is correctly aligned in slot 24. Lid member 28 is then subjected to a bonding or welding process to permanently seal the cremation ashes in card base 12. A heat sealing machine such as a laminator could be used in this process, as well as other types of heat sealing processes known to those skilled in the art, such as radio frequency heat sealing.

Once card 10 has been heat sealed to secure lid member 28 in opening 24 leading to slot or compartment 20, the cremation ashes will be permanently sealed in card base 12, so that there is no chance of the ashes inadvertently escaping under normal use conditions. Then, each card 10 may be personalized by applying graphic and printed material to the front and rear surfaces 13 and 14 of the card base 12. Such material will typically include a photograph of the deceased, a religious prayer, resume material, and graphics, but may also include any desired customized wording or other graphic material. Such graphics and/or printing may be applied in several different manners using plastic printing processes, such as a dual side thermal plastic color printer connected to a computer having on its hard drive card production software for using said printer and other features which make it compatible and capable of communicating with said printer. An example of such a printer is the HP Indigo Press S2000. Minimum specifications of the computer are those required of the printer, and such card production software would be compatible with and operable on any basic computer system currently available on the PC market. A front and rear transparent overlay may be provided over the graphic material. While a printing process is preferred, such graphical and other material for personalizing each card may be applied to card base 12 in other manners as well, such as using an adhesive applied to the back surface of a sticker, label, or the like.

Figure 4:
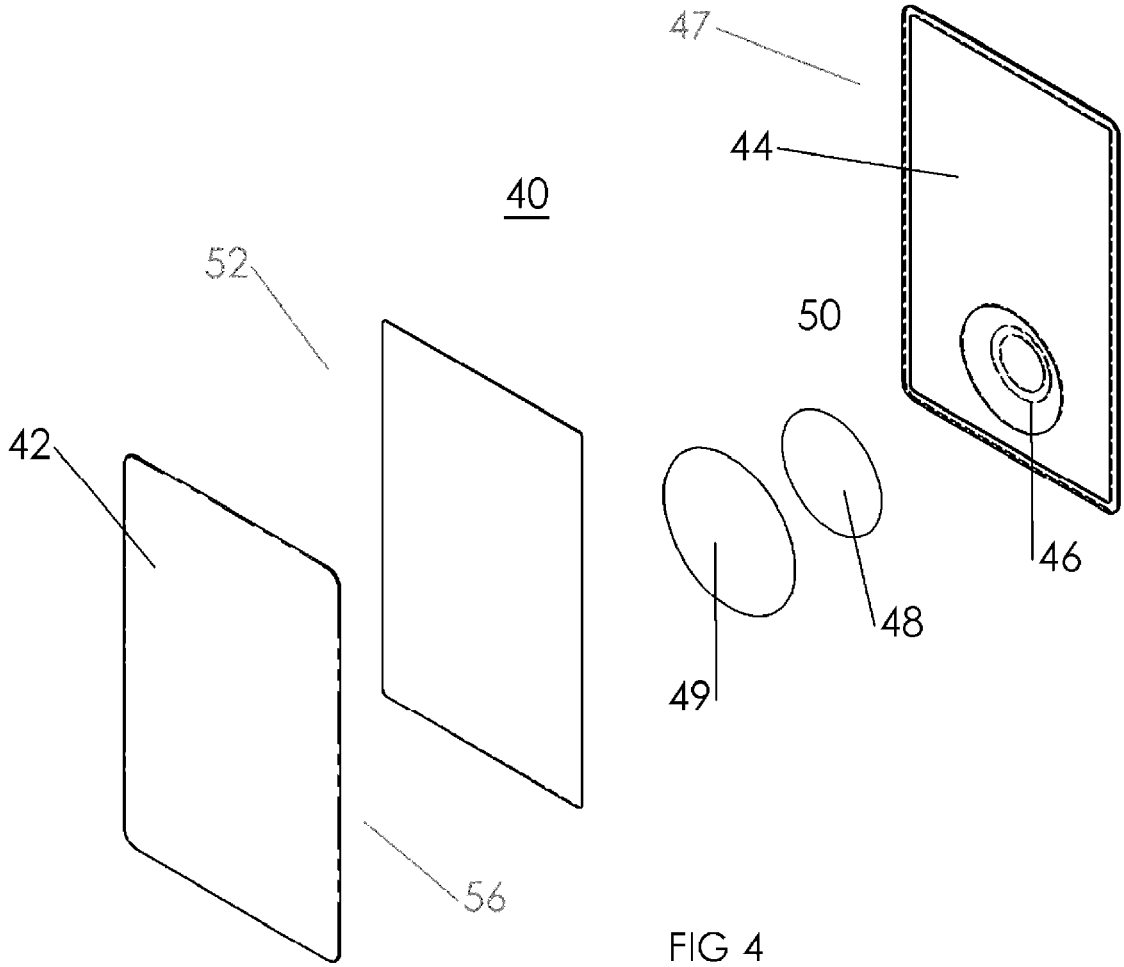
FIG. 4 is a perspective exploded view of an alternative embodiment of the memorial card of the present invention.
Figure 5:
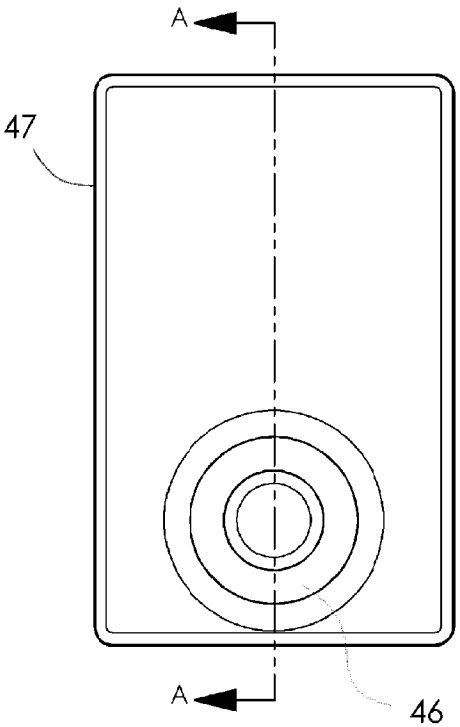
FIG. 5 is a front view and FIG. 6 a sectional view taken along line A-A in FIG. 5 in the direction of the arrows of the memorial card shown in FIG. 4.
Figure 6:
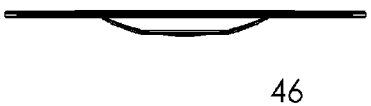
Figure 7:
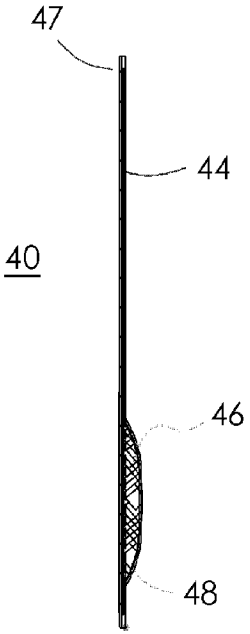
FIG. 7 is a close-up side view of the memorial card shown in FIGS. 4-6.
Figure 8:
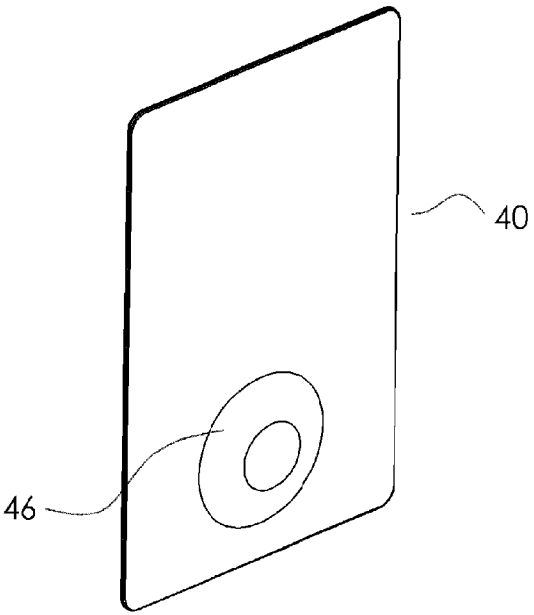
FIG. 8 is an isometric view from the top of the memorial card shown in FIGS. 4-7.
Figure 9:
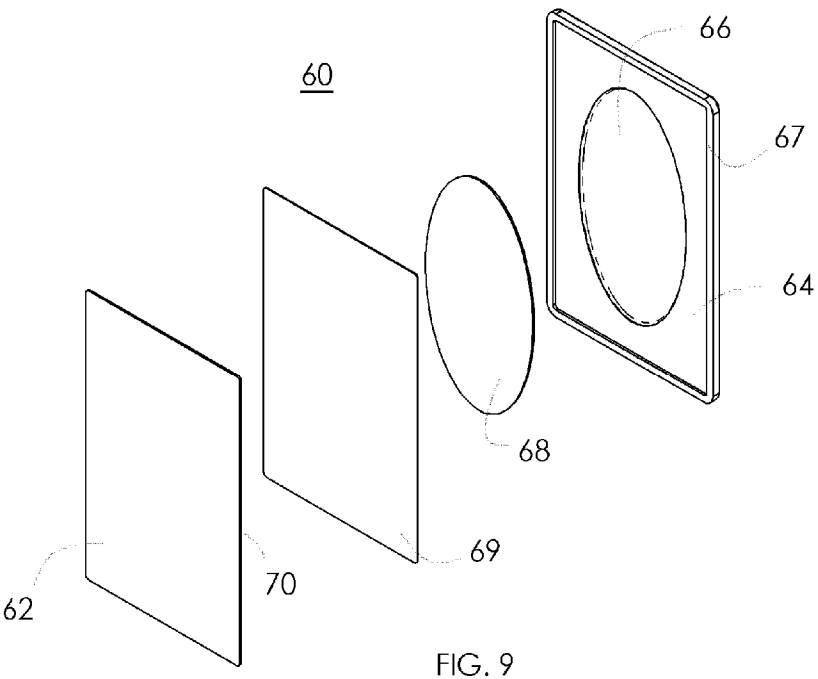
FIG. 9 is a perspective exploded view of another embodiment of the memorial or legacy card of the present invention.
Figure 11:
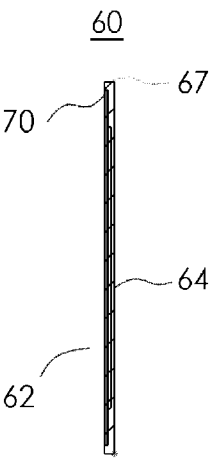
FIG. 11 is a sectional side view of the memorial card shown in FIGS. 9 and 10 taken along line A-A in FIG. 10.

FIGS. 4-8 illustrate another preferred embodiment of the memorial or legacy card of the present invention, which cards, rather than being formed from a single card base having integral front and rear surfaces as in the embodiment shown in FIGS. 1-3, is manufactured using a lamination process, wherein the cremains or cremation ashes and a card containing personalized graphics and other material are sandwiched between two transparent or translucent plastic laminates. More particularly, as shown in FIG. 4, laminated memorial card 40 includes a front laminate sheet 42 and a base laminate sheet 44 having substantially the same shape and size, although base sheet 44 is slightly larger and includes an inwardly facing raised ridge 47 formed around its periphery to facilitate sealing of the laminates 42 and 44 together as described below. In addition, base laminate sheet 44 has an outwardly protruding cup or pocket 46 integrally formed in its side surface for holding a small amount of cremation ashes.

In one possible method of forming memorial card 40, base laminate sheet 44 is placed on a flat horizontal surface with the mouth 50 of pocket 46 and raised ridge 47 facing upwardly. A small amount of cremains 48 is then inserted in pocket 46, and is secured in pocket 46 in a suitable manner, such as by placing a thin tape or foil 49 over the mouth 50 of pocket 46. The tape or foil is used to keep the ashes from spilling out of pocket 46 while the other components of the card are prepared, and to keep such ashes in position in pocket 46. Tape or foil 49 may be either opaque or transparent, likely depending upon the light transmitting properties of the material used to form card insert 52, which is placed over tape or foil 49 as well as the remainder of card base 44. For example, if card insert 52 is transparent or does not extend over pocket 46, tape or foil will typically also be transparent, but if card insert 52 is not transparent or does extend over pocket 46, the tape or foil will usually be opaque. Card insert 52 preferably has dimensions that are roughly the same as or slightly smaller than the dimensions of front laminate sheet 42, and includes a front side 53 and a rear side 54 (see FIGS. 15-16), and will be usually be positioned so that front side 53 is visible through laminate sheet 42. Card 52 is made from a suitably rigid card stock and will have personalized graphics, text, or other material or information related to the deceased printed or otherwise applied on both sides, which material will be visible through the laminate. It will be noted that the rear side 53 of the card has the memorial statement position near the upper portion of the card so as to avoid interference with the cremains pocket 46. See FIG. 16. Front laminate sheet 42 is thus sized so that when it is brought together with base laminate sheet 44, the edges of front sheet 42 fit seamlessly against the inner periphery of raised ridge 47 on base laminate sheet 44. The laminates 42 and 44 are then subjected to a lamination process by which the laminates are joined, hermetically sealing the cremains 48 and card 52 between such laminates. In addition, pocket 46 may be either transparent or translucent so that cremains 48 are visible from the outside, or may be darkened or otherwise covered so that the cremains are not visible, depending upon the personal preference of the card owner or purchaser.

FIGS. 9-12 illustrate another preferred embodiment of the memorial or legacy card of the present invention, which embodiment has features in common with each of the previously described embodiments, and which card manufactured using a lamination process, but the cremains or cremation ashes are contained in a cavity that is within the dimensions or thickness of the card, rather than having a cup or cavity protruding outwardly from the base laminate sheet as in the embodiment shown in FIGS. 4-8. More particularly, card 60 includes a top laminate sheet 62 and a base laminate sheet 64, both of which have essentially the same shape, with top sheet 62 being slightly smaller than base sheet 64 as described below. Top laminate sheet 62 is of a uniform thickness and substantially flat on both sides, while base laminate sheet 64 has a slightly greater thickness than top laminate sheet 62 allowing room for oval cavity 66 for receiving a small amount of cremation ashes 68 to be formed in the inner surface of base sheet. In addition, a raised ridge 67 is formed around the periphery of base laminate sheet 64 to facilitate sealing of the laminates 62 and 64 together as described below.

Figure 12:
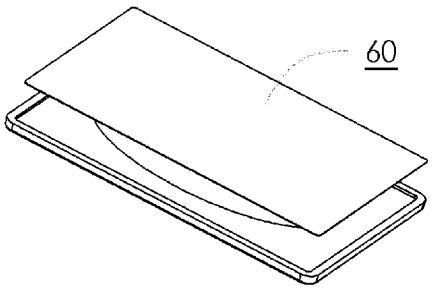
FIG. 12 is an isometric view of the physical embodiment of the memorial card shown in FIGS. 9-11.
Figure 10:
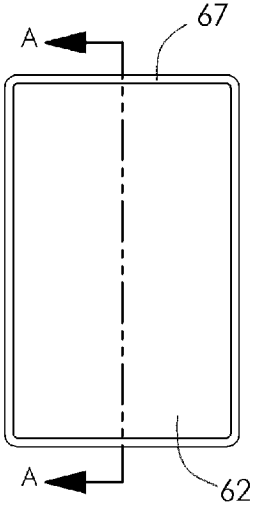
FIG. 10 is a front view of the memorial card shown in FIG. 9.

In one method of forming memorial or legacy card 60, base laminate sheet 64 is placed on a flat horizontal surface with cavity 66 and raised ridge 67 facing upwardly. A small amount of cremation ashes 68 is then inserted in cavity 66, either directly or after first being applied to a thin foil to keep the ashes spread out evenly, and which together are inserted into cavity 66. A thin tape or foil 69 is then secured over cavity 66 to secure the ashes in such cavity and to prevent the ashes from spilling out of pocket 66 while the other components of the card are prepared. As shown in sectional view in FIG. 11, top laminate sheet 62 is then placed over tape 69 and brought together with base laminate sheet 64, so that the edges 70 of top sheet 62 fit seamlessly against the raised ridge 67 on base laminate sheet 44. The laminates 62 and 64 are then subjected to a lamination process by which the laminates are joined, hermetically sealing the cremation ashes 68 between such laminates, so that there is no chance of the ashes inadvertently escaping under normal conditions. FIG. 12 illustrates a sealed memorial or legacy card 60. Then, each card 60 may be personalized by applying graphic or printed material to the front and rear surfaces of the card 60, in the same manner as was described above with reference to FIGS. 1-3 and 15-16 herein. Such material will typically include a photograph of the deceased, a religious prayer, resume material, and other graphics, but may also include any desired customized wording or graphic material that is desired.

Figure 13:
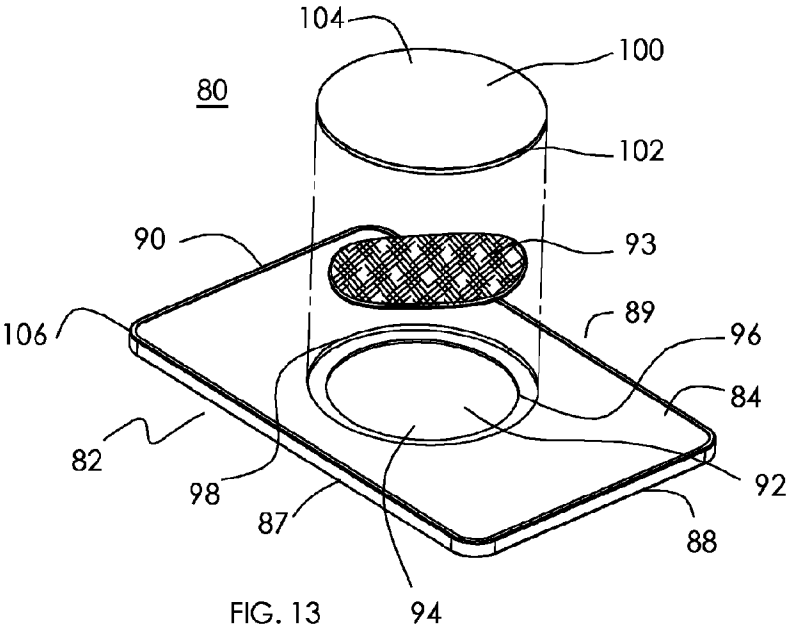
FIG. 13 is an isometric exploded view of another preferred embodiment of the memorial or legacy card of the present invention.
Figure 14:
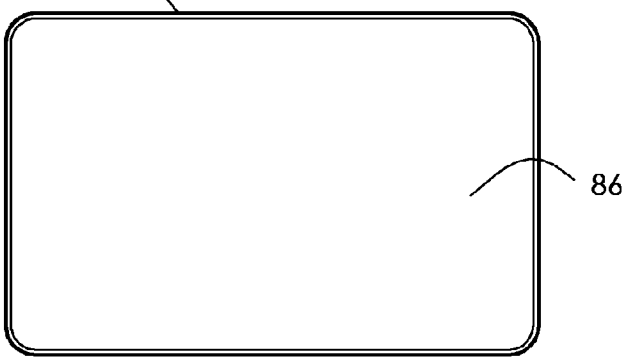
FIG. 14 is a rear elevation view of the card shown in FIG. 13.

FIGS. 13-14 illustrate another preferred embodiment of the memorial or legacy card of the present invention, which embodiment is somewhat similar to the embodiment described with reference to FIGS. 9-12 above in that the cremains or cremation ashes are contained in a cavity within the dimensions or thickness of the card base, rather than in a cup or cavity protruding outwardly from the base laminate sheet as in FIGS. 4-8. More particularly, memorial card 80 includes a base sheet 82 formed from PVC or other suitable material such as Lexan®, a polycarbonate resin thermoplastic available from General Electric Company, having flat top and bottom surfaces 84 and 86, and side surfaces 87, 88, 89, and 90, respectively. Preferably, such embodiment will have the exact dimensions of a conventional credit card, but will be approximately three times the normal thickness of a conventional credit card, so that cavity 92 for receiving a small amount of cremation ashes 93 may be formed in base sheet 82, opening to top surface 84. Cavity 92 has a floor or bottom surface 94 and a stepped or elevated area 96 surrounding bottom surface 94, which stepped or elevated area 96 in combination with sidewalls 98 of cavity 92 between step 96 and top surface 84 serve as a frame for receiving cap member 100, in addition to in combination with the depth of cavity 92 defining the amount of cremation ashes that can be received in cavity 92. When cap or lid member 100 is disposed over cavity 92, the opening into cavity 92 is completely closed off and sealed, with the peripheral bottom surface of cap 100 resting on the step 96, and with side walls 98 of cavity 92 abutting against circumferential sidewalls 102 of cap 100. Cap 100 is sized so that when it is inserted into cavity 92 and is supported on step 96, such fit is very tight and the cap will be frictionally held in place over the opening into cavity 92. An adhesive or other means known to those skilled in the art can also be used in addition to permanently seal cap 100 in place over cavity 92, and such additional means it has been found are not required as the presently described arrangement is sufficient to prevent any cremation ashes from escaping. Top surface 104 of cap 100 when secured in cavity 92 will be flush with top surface 84 of base sheet 82, and together form a unitary flat surface on which a sheet containing graphics and other materials as described elsewhere herein to personalize memorial or legacy card 80 is secured. The graphics sheet will be permanently secured to top surface 84, preferably by means of an adhesive, which sheet will also cover and serve to further permanently secure cap 100 in place. A raised ridge 106 is formed around the periphery of top surface 84 of base sheet 82, which ridge prevents the edges of the graphics containing sheet applied on top surface 84, which sheet will preferably be sized to fit over the entire top surface 84 of base 82 up to the edge of ridge 106, from either intentionally or inadvertently through normal use of the card peeling or being peeled off or removed. Similarly, as shown in FIG. 14, a raised ridge 108 is formed around the periphery of bottom surface 86 of base sheet 82 to prevent a sheet containing graphics and other material applied to bottom surface 86 from being intentionally or inadvertently peeled off or removed.

Figure 15:
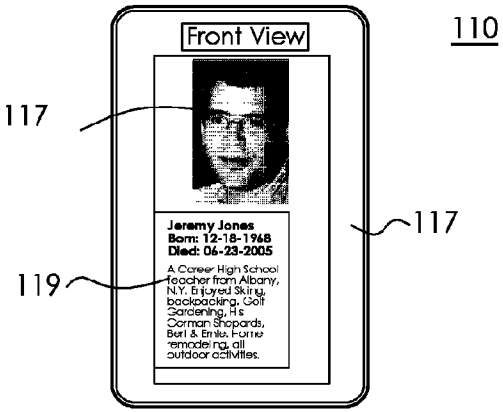
FIGS. 15 and 16 illustrate sample front and rear sides of the memorial cards of the invention.
Figure 16:
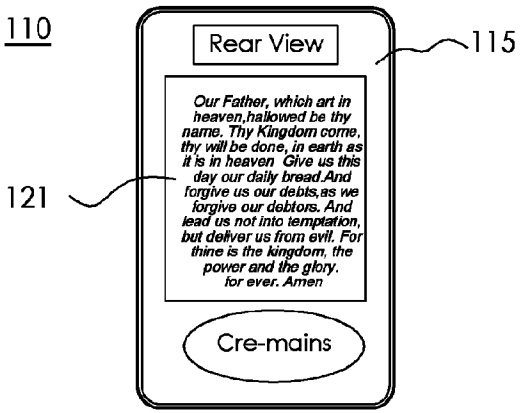

FIGS. 15 and 16 illustrate an example of possible graphics 110 for use with the memorial or legacy cards of the present invention, having a front side 113 and rear side 115. Front side 113 includes an image or photograph 117 of the deceased, and positioned below such image or photograph 117 is a section 119 containing personal information about the deceased, including the name, birth date, death date, and other relevant personal or interesting and memorable information regarding such person. Rear side 115 of card 110 also contains graphic or other printed material, such as the religious prayer 121 illustrated and commonly provided on conventional remembrance cards. The text or material on rear side 115, at least in the embodiment shown in FIGS. 4-8, should be positioned towards the top of such card, to accommodate pocket 46 so that it is visible through base laminate sheet 44. Alternatively, card 110 can be formed of two separate sheets, with the rearwardly facing sheet having an oval cut out so that the cremains 48 are visible. As indicated above, the cards may be created in any suitable manner, but are preferably created using a suitable software program of a type currently available on the PC market. In the embodiments shown in the other Figures, there is no need to accommodate pocket 46, as the cremains are sealed in a pocket within the outermost dimensions of the card.

The memorial or legacy cards just described are impervious to water and other external elements that might otherwise come between the laminated and damage or disturb the card and cremains. In addition, the finished cards are portable and sized to fit easily in one's wallet or purse, and thus a loved one can be with the owner of the card at all or any time and can accompany the owner everywhere he or she goes, and the memory of the deceased can be easily retrieved and viewed whenever desired. The card can be taken to church and used during prayer for the lost loved one, or shared with friends or family of the deceased that were unable to attend the service, or used as a remembrance years later. While the cards are illustrated and described as having a rectangular shape, it will be understood that such cards could have other shapes, such as square, round, oval, and the like without falling outside the scope of the invention, although the rectangular shape and credit card size is preferred so that the card can be carried in a wallet with similar sized cards.

The top face of the printed graphic card may have a digital picture of the deceased towards the top, with date of birth and date of passing engraved digitally below the picture or along the side. A text box below the date of passing is used for describing the person. This area is provided to tell surviving family members, friends, colleagues who this person was and what the deceased enjoyed as hobbies, interests, career, spouse, children etc. This printed graphic card, once complete will be positioned face up. In addition, while the card has been described primarily as a remembrance item for a deceased human being, such item may also be used as a remembrance for a loved pet or animal.

It is contemplated that such cards can be made to order, and could be marketed to funeral directors either for distribution or purchase, or directly to the general population. A funeral director, upon commencing administration of a funeral, could make the family of the deceased aware of the memorial cards of the present invention and then place an order for a certain number of such cards, having graphics, personal information, prayers, and the like selected by the family. The cards can then be made either by funeral staff or other commercial provider after the cremation process has taken place.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A memorial card to serve as a remembrance item having a small amount of cremains of a deceased sealed in the card comprising:

a. a base section sized to be received in the pocket of a wallet defined by front and rear surfaces and upper, lower, and side edges and, having an integral cavity formed in one of said front or rear surfaces of the card for receiving the small amount of cremains, said cavity having a floor section and side walls defining a cremains receiving area of said cavity, and a stepped area surrounding said cremains receiving area, and b. a cap member member insertable into the stepped area of said cavity for permanently sealing said cremains in the cavity, whereby survivors of the deceased can retain and conveniently carry said card as a remembrance of the deceased.

2. The memorial card of claim 1 having on at least one of said front and rear surfaces information related to the deceased.

3. The memorial card of claim 1 wherein when said cap member is secured in said stepped area, the top surface of the cap member is flush with the front or rear surface of the base section.

4. The memorial card of claim 3 additionally comprising a peripheral ridge on at least the front or rear surfaces of the base section.

5. The memorial card of claim 4 additionally comprising a peripheral ridge on the front and rear surfaces of said base section.

6. The memorial card of claim 1 wherein said base section and cap member are formed of Polycarbonate.

7. The memorial card of claim 1 wherein said cavity is confined within the physical dimensions of the base section.

8. A memorial card to serve as a remembrance item having a small amount of cremains of a deceased sealed in the card comprising:

a. a base section defined by front and rear surfaces and upper, lower, and side edges, having a height of approximately 54 mm, a width dimension of about 85.5 mm, and a thickness of about 2.7 mm, and an integral cavity for receiving the small amount of cremains, b. said cavity having a floor section and side walls defining a cremains receiving area of said cavity, and a stepped area surrounding said cremains receiving area, in which stepped area a cap member is received to permanently seal the cavity, whereby survivors of the deceased can retain and conveniently carry said card as a remembrance of the deceased.

* * * * *